US011445580B2

(12) United States Patent
Xu et al.

(10) Patent No.: US 11,445,580 B2
(45) Date of Patent: Sep. 13, 2022

(54) MICROWAVE-BASED HIGH-THROUGHPUT MATERIAL PROCESSING DEVICE WITH CONCENTRIC ROTARY CHASSIS

(71) Applicant: Kunming University of Science and Technology, Kunming (CN)

(72) Inventors: Lei Xu, Kunming (CN); Jinhui Peng, Kunming (CN); Shenghui Guo, Kunming (CN); Libo Zhang, Kunming (CN); Zhaohui Han, Kunming (CN); Yi Xia, Kunming (CN); Shaohua Ju, Kunming (CN); Shanju Zheng, Kunming (CN); Shiwei Li, Kunming (CN); Zemin Wang, Kunming (CN); Zhang Xu, Kunming (CN)

(73) Assignee: KUNMING UNIVERSITY OF SCIENCE AND TECHNOLOGY, Kunming (CN)

( * ) Notice: Subject to any disclaimer, the term of this patent is extended or adjusted under 35 U.S.C. 154(b) by 357 days.

(21) Appl. No.: 16/839,195

(22) Filed: Apr. 3, 2020

(65) Prior Publication Data

US 2020/0323051 A1 Oct. 8, 2020

(30) Foreign Application Priority Data

Apr. 8, 2019 (CN) ..... 201910274579.3

(51) Int. Cl.
*H05B 6/68* (2006.01)
*H05B 6/64* (2006.01)

(52) U.S. Cl.
CPC ..... *H05B 6/686* (2013.01); *H05B 6/6411* (2013.01)

(58) Field of Classification Search
CPC ..... H05B 6/686; H05B 6/6411; H05B 6/80
See application file for complete search history.

(56) References Cited

U.S. PATENT DOCUMENTS

2010/0032429 A1* 2/2010 Rundquist ..... F27B 14/14 219/690

FOREIGN PATENT DOCUMENTS

CN 108823635 * 11/2018

* cited by examiner

*Primary Examiner* — Benjamin Tzu-Hung Liu
(74) *Attorney, Agent, or Firm* — IP Attorneys Group, LLC

(57) ABSTRACT

The present invention provides a microwave-based high-throughput material processing device with a concentric rotary chassis. The device includes a microwave source generator, a microwave reaction chamber, and a temperature acquisition device. The microwave reaction chamber is provided with a rotary table, a thermal insulation barrel and a crucible die. The thermal insulation barrel is disposed on the rotary table, and the crucible die is disposed in the thermal insulation barrel. The crucible die is provided with a plurality of first grooves, and the first grooves are evenly distributed on a first circumference. A plurality of first fixing holes are disposed on a top of the thermal insulation barrel, and the first fixing holes are disposed corresponding to the first grooves. A first acquisition hole is disposed on the top of the microwave reaction chamber, and the first acquisition hole is located right above the first circumference.

10 Claims, 5 Drawing Sheets

MICROWAVE-BASED HIGH-THROUGHPUT MATERIAL PROCESSING DEVICE WITH CONCENTRIC ROTARY CHASSIS

TECHNICAL FIELD

The present invention relates to the field of microwave-based high-throughput technologies, and in particular, to a microwave-based high-throughput material processing device with a concentric rotary chassis.

BACKGROUND

The high-throughput preparation of materials refers to preparation of a large number of samples in a short period of time, in which a quantitative change causes a qualitative change in material research efficiency. Currently, high-throughput material research methods have been widely used in the field of material preparation, and provide an entirely new way to accelerating the development of new materials, optimization of existing materials and devices, and in-depth exploration of physical mechanisms.

Microwave is a high-frequency electromagnetic wave. When it interacts with materials, microwave energy is converted into thermal energy through dielectric loss. Microwave can simultaneously heat a sample internally and externally, and its unique heating characteristics can help prepare materials with a uniform structure and fine grains. In addition, microwave can also reduce the reaction temperature, shorten reaction time, and achieve energy conservation and consumption reduction. During transportation in space, microwave electromagnetic fields are evenly distributed, and act on materials in a non-contact manner, which can heat multiple batches of materials at the same time. Therefore, microwave has broad application prospects and technical advantages in high-throughput preparation of materials. A traditional electric heating furnace and an electromagnetic induction heating melting furnace are usually accompanied with uneven heating in the heating process, and it is difficult to realize simultaneous sintering, melting or heat treatment of multiple batches of materials. As a result, microwave-based heating is used to achieve high-throughput preparation of materials, but equipment used for temperature acquisition of materials in different crucibles is complicated and has poor operability.

Therefore, there is an urgent need for a device that can achieve synchronous or asynchronous rapid melting and temperature data acquisition of multiple batches of metal materials and make the temperature acquisition process become simple and convenient.

SUMMARY

An objective of the present invention is to provide a microwave-based high-throughput material processing device with a concentric rotary chassis, which can achieve synchronous or asynchronous rapid melting and temperature data acquisition of multiple batches of metal materials and make the temperature acquisition process become simple and convenient.

To achieve the above purpose, the present invention provides the following technical solution.

A microwave-based high-throughput material processing device with a concentric rotary chassis includes a microwave source generator, a microwave reaction chamber, and a temperature acquisition device; where the microwave source generator is configured to generate a microwave, and transmit the microwave to the microwave reaction chamber through a waveguide tube;

the microwave reaction chamber is provided with a rotary table, a thermal insulation barrel and a crucible die; the rotary table is disposed at a bottom of the microwave reaction chamber, the thermal insulation barrel is disposed above the rotary table, the crucible die is disposed at a bottom of the thermal insulation barrel, and the crucible die is configured to place a crucible 106);

the crucible die is provided with a plurality of first grooves, where the first grooves are configured to place the crucible, and the first grooves are evenly distributed on a first circumference; a plurality of first fixing holes are disposed on a top of the thermal insulation barrel, and the first fixing holes are disposed corresponding to the first grooves; a first acquisition hole is disposed on the top of the microwave reaction chamber, and the first acquisition hole is located right above the first circumference; and when the thermal insulation barrel rotates with the rotary table, the temperature acquisition device is configured to acquire temperature of materials in the crucible through the first acquisition hole and the first fixing hole.

Optionally, the device further includes a control system, where the control system is respectively connected to the temperature acquisition device and the microwave source generator, and the control system adjusts power of the microwave source generator based on temperature data acquired by the temperature acquisition device.

Optionally, the device further includes a pressure measuring device, configured to measure a pressure in the microwave reaction chamber; the microwave reaction chamber is provided with an intake pipe and an exhaust pipe, where the intake pipe is provided with an intake valve, and the exhaust pipe is provided with an exhaust valve; and the control system is respectively connected to the pressure measuring device, the intake valve, and the exhaust valve, and the control system controls opening and closing of the intake valve or the exhaust valve based on pressure data.

Optionally, the device further includes a vacuum pump, the vacuum pump is communicated with the microwave reaction chamber, and the vacuum pump is configured to vacuum ize gas in the microwave reaction chamber.

Optionally, the device further includes a circulating water cooler, and the circulating water cooler is communicated with a water cooled jacket on the microwave source generator and is configured to cool the microwave source generator.

Optionally, the crucible die is also provided with a plurality of second grooves, where the second grooves are configured to place the crucible, and the second grooves are evenly distributed on a second circumference; the first circumference and the second circumference are concentric circles, a plurality of second fixing holes are disposed on a top of the thermal insulation barrel, and the second fixing holes are disposed corresponding to the second grooves; a second acquisition hole is disposed on the top of the microwave reaction chamber, and the second acquisition hole is located right above the second circumference; and when the thermal insulation barrel rotates with the rotary table, the temperature acquisition device is configured to acquire temperature of materials in the crucible through the second acquisition hole and the second fixing hole.

Optionally, the crucible is a silicon carbide crucible or a silicon carbide crucible doped with aluminum oxide, silicon oxide, or iron oxide.

Optionally, the temperature acquisition device is an infrared thermometer.

Optionally, the thermal insulation barrel is made of mullite materials.

Optionally, the rotary table is made of titanium plates.

Compared with the prior art, the present invention discloses the following technical effects.

In the present invention, a microwave reaction chamber is provided with a rotary table, a thermal insulation barrel, and a crucible die. The thermal insulation barrel is disposed on the rotary table, and the crucible die is disposed in the thermal insulation barrel. The crucible die is provided with a plurality of first grooves, where the first grooves are configured to place the crucible, and the first grooves are evenly distributed on a first circumference. A plurality of first fixing holes are disposed on a top of the thermal insulation barrel, and the first fixing holes are disposed corresponding to the first grooves. A first acquisition hole is disposed on the top of the microwave reaction chamber, and the first acquisition hole is located right above the first circumference. When the thermal insulation barrel rotates with the rotary table, the temperature acquisition device is configured to acquire temperature of materials in the crucible through the first acquisition hole and the first fixing hole. The device of the present invention can achieve synchronous or asynchronous rapid melting and temperature data acquisition of multiple batches of metal materials, and the device is simple and efficient, and is easy to operate and maintain.

BRIEF DESCRIPTION OF THE DRAWINGS

To describe the technical solutions in the embodiments of the present invention or in the prior art more clearly, the following briefly introduces the accompanying drawings required for describing the embodiments. Apparently, the accompanying drawings in the following description show merely some embodiments of the present invention, and a person of ordinary skill in the art may still derive other accompanying drawings from these accompanying drawings without creative efforts.

DETAILED DESCRIPTION

The following clearly and completely describes the technical solutions in the embodiments of the present invention with reference to accompanying drawings in the embodiments of the present invention. Apparently, the described embodiments are merely a part rather than all of the embodiments of the present invention. All other embodiments obtained by a person of ordinary skill in the art based on the embodiments of the present invention without creative efforts shall fall within the protection scope of the present invention.

The present invention provides a microwave-based high-throughput material processing device with a concentric rotary chassis, which can achieve synchronous or asynchronous rapid melting and temperature data acquisition of multiple batches of metal materials, and make the temperature acquisition process become simple and convenient.

In order to make the above objectives, features, and advantages of the present invention more apparent, the present invention will be further described in detail in connection with the accompanying drawings and the detailed description.

Figure 1:
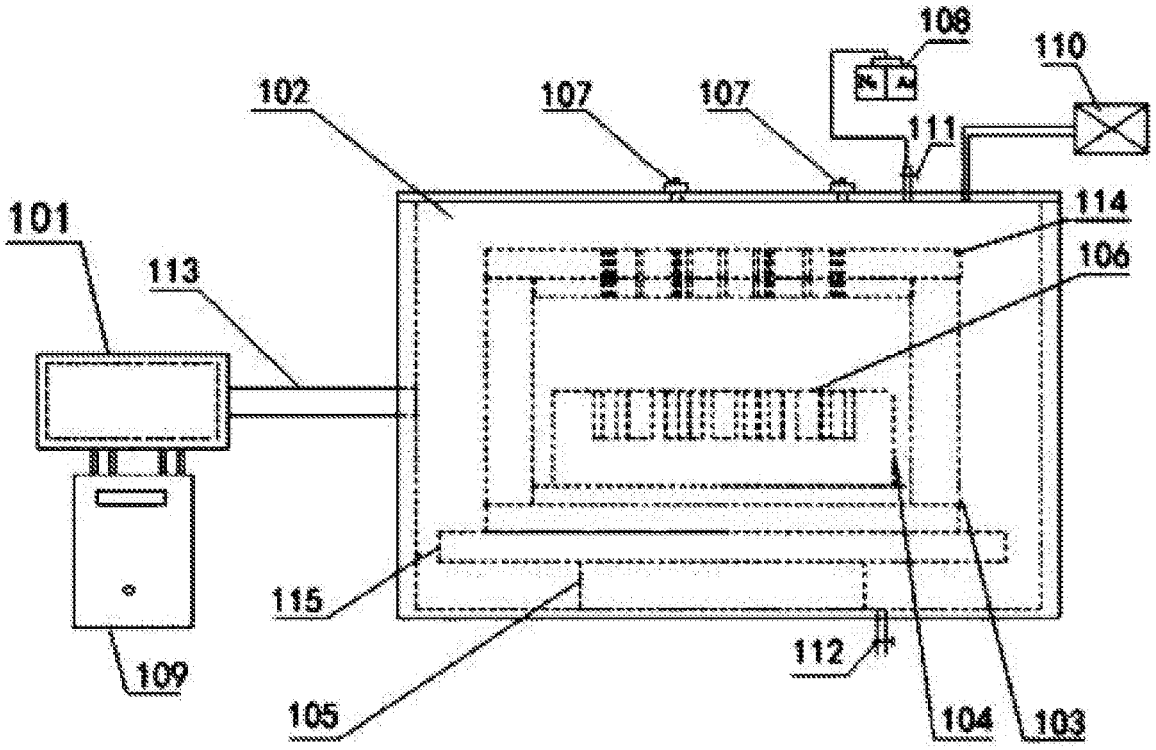
FIG. 1 is a schematic diagram of a cross-section structure of a microwave-based high-throughput material processing device with a concentric rotary chassis according to an embodiment of the present invention.
Figure 2:
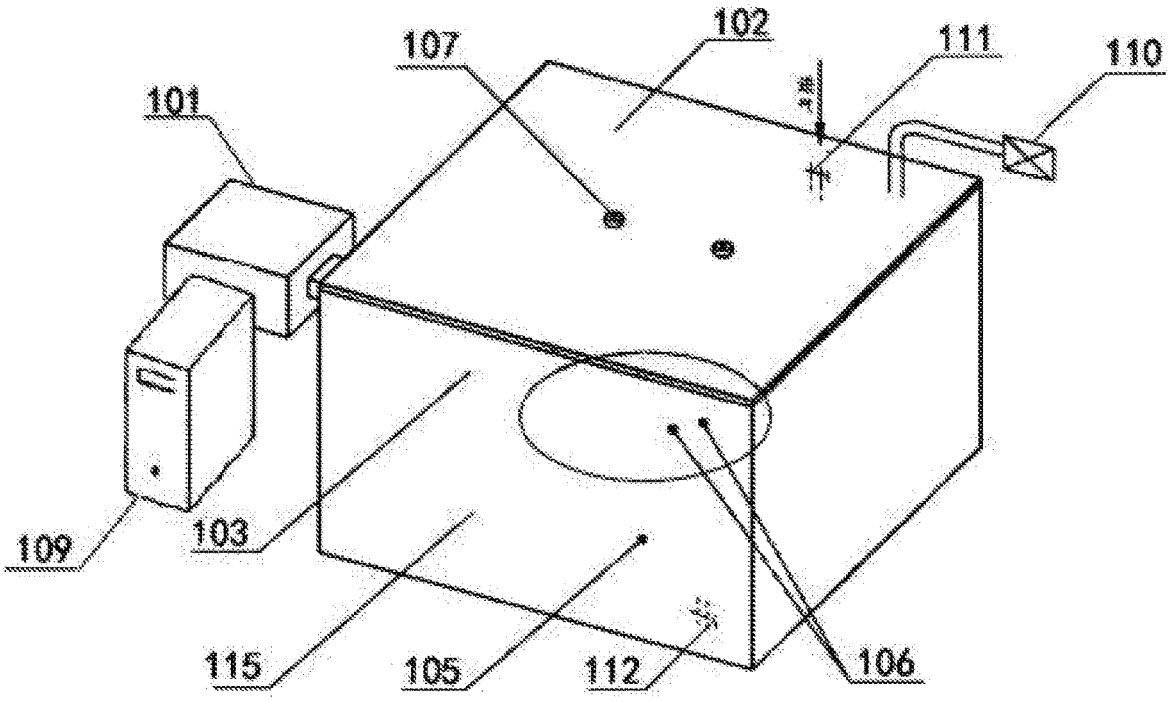
FIG. 2 is a schematic diagram of a stereochemical structure of a microwave-based high-throughput material processing device with a concentric rotary chassis according to an embodiment of the present invention.
Figure 3:
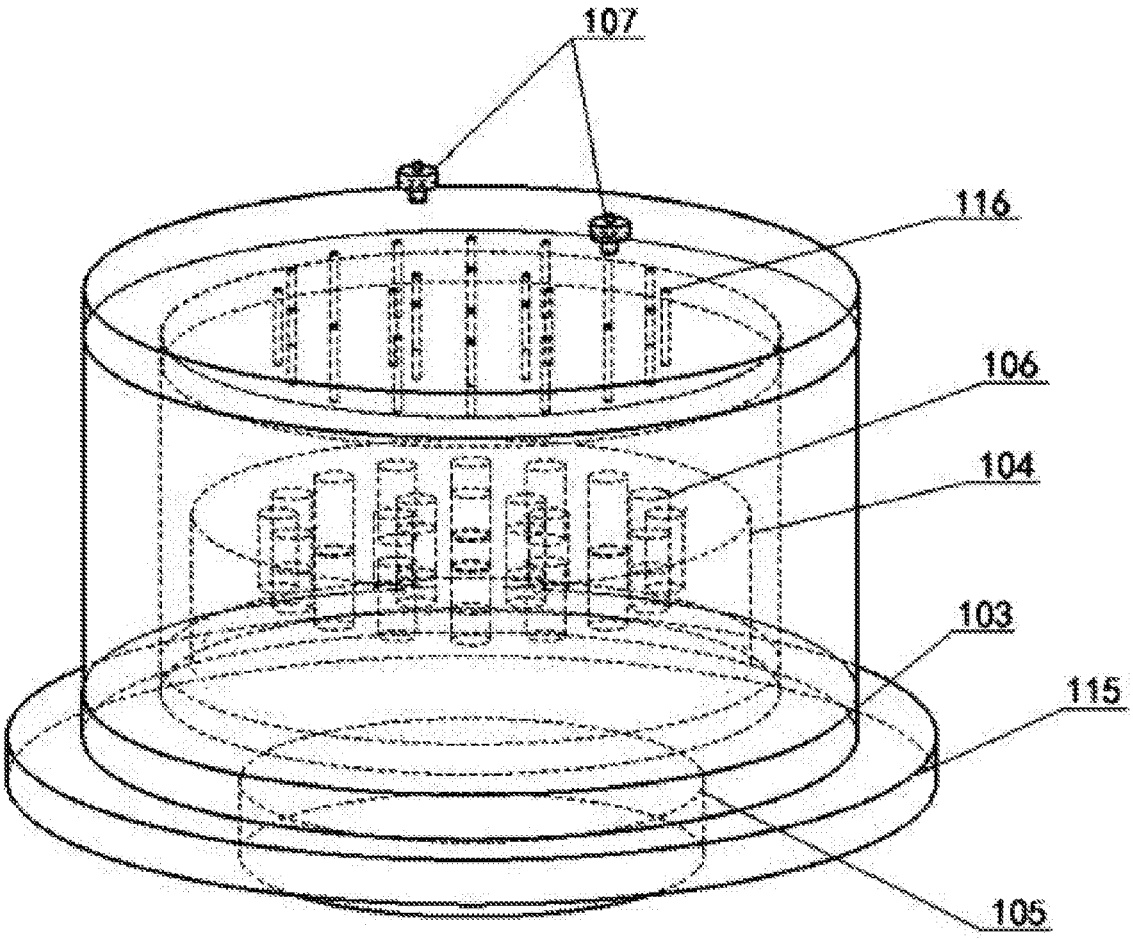
FIG. 3 is a schematic structural diagram of a microwave reaction chamber according to an embodiment of the present invention.

FIG. 1 is a schematic diagram of a cross-section structure of the microwave-based high-throughput material processing device with a concentric rotary chassis according to an embodiment of the present invention. FIG. 2 is a schematic diagram of a stereochemical structure of the microwave-based high-throughput material processing device with a concentric rotary chassis according to an embodiment of the present invention. FIG. 3 is a schematic structural diagram of a microwave reaction chamber according to an embodiment of the present invention.

Referring to FIG. 1 to FIG. 3, the microwave-based high-throughput material processing device with a concentric rotary chassis of an embodiment of the present invention includes a microwave source generator 101, a microwave reaction chamber 102, and a temperature acquisition device 107. The microwave source generator 101 is configured to generate a microwave, and transmit the microwave to the microwave reaction chamber 102 through a waveguide tube 113.

Specifically, the microwave source generator 101 is communicated with the microwave reaction chamber 102 through a rectangular waveguide tube 113. The waveguide tube 113 is connected to the microwave source generator 101 through a flange, where a cross section of a connection port of the flange is rectangular, including but not limited to the form prescribed by national standard BJ22-26. The microwave reaction chamber 102 is sealed between the waveguide 113 and the microwave reaction chamber 102 by using a tetrafluoro gasket, a mullite ceramic sheet, or a quartz glass sheet, with a thickness of the sealing sheet about 2-5 mm. The microwave source generator 101 can use a single microwave source ora combination of multiple microwave sources to achieve power adjustment, and the power is 0-20 kW, but it is not limited to this. In this embodiment of the present invention, the combination of multiple microwave sources is used, with a frequency of the microwave source of 2450±50 MHz or 915±50 MHz, a total microwave power of 0-20 kW, and a heating rate can be controlled by adjusting the total microwave power.

The microwave reaction chamber 102 is provided with a rotary table 105, a thermal insulation barrel 103 and a crucible die 104. The rotary table 105 is disposed at a bottom of the microwave reaction chamber 102, the thermal insulation barrel 103 is disposed above the rotary table 105, the crucible die 104 is disposed at a bottom of the thermal insulation barrel 103, and the crucible die 104 is configured to place a crucible 106.

The crucible die 104 is provided with a plurality of first grooves, where the first grooves are configured to place the crucible 106, and the second grooves are evenly distributed on a first circumference. A plurality of first fixing holes are disposed on a top of the thermal insulation barrel 103, and the first fixing holes are disposed corresponding to the first grooves. A first acquisition hole is disposed on the top of the microwave reaction chamber 102, and the first acquisition hole is located right above the first circumference. When the thermal insulation barrel 103 rotates with the rotary table 105, the temperature acquisition device 107 is configured to acquire temperature of materials in the crucible 106 through the first acquisition hole and the first fixing hole.

Specifically, the microwave reaction chamber 102 has a stainless steel rectangular structure, and the wall thickness of the chamber is 1-3 mm. The inner wall of the chamber is made of polycrystalline mullite materials, which can keep warm and has a heat resistance temperature of 1400° C. A furnace cover 114 is disposed on the top of the microwave reaction chamber 102, and the furnace cover 114 is fastened by a detachable buckle bolt. A furnace bottom is disposed on the bottom, and the upper furnace cover 114 and the lower furnace bottom both are sealed by sealing rings, which can achieve that the microwave reaction chamber 102 can be operated under vacuum-sealed or protective atmosphere-sealed conditions.

The thermal insulation barrel 103 is made of mullite materials, a barrel cover is disposed on the top of the thermal insulation barrel 103, and a plurality of first fixing holes are disposed on the barrel cover. A first acquisition hole is disposed on the furnace cover 114, and an infrared thermometer is disposed on the top of the first acquisition hole. The furnace bottom is provided with a rotary table 105, the rotary table 105 is provided with the thermal insulation barrel 103, and the thermal insulation barrel 103 rotates with the rotation of the rotary table 105. When the rotary table 105 rotates, the thermal insulation barrel 103 also rotates, thereby driving the crucible die 104 to move, so that the crucible 106 is moved in a circumference. In this process, the relative positions of the first fixing hole and the crucible 106 are not changed, the relative positions of the first acquisition hole and the first fixing hole are changed, and the infrared thermometer measures the temperature of materials in the crucible 106 through the first acquisition hole and the first fixing hole. The temperature measurement interval is adjusted by controlling the rotation speed of the rotary table 105, materials in different crucibles 106 are acquired through the above device, and the device is simpler and has strong operability.

As an embodiment of the present invention, the device further includes a control system, where the control system is respectively connected to the temperature acquisition device 107 and the microwave source generator 101, and the control system adjusts power of the microwave source generator 101 based on temperature data acquired by the temperature acquisition device 107.

Specifically, the control system uses a touch screen PLC full-automatic intelligent control, which can directly display and output experimental data, and can also be connected to corresponding computer equipment for data storage and analysis.

As an embodiment of the present invention, the device further includes a pressure measuring device, configured to measure a pressure in the microwave reaction chamber 102. The microwave reaction chamber 102 is provided with an intake pipe and an exhaust pipe, where the intake pipe is provided with an intake valve 111, and the exhaust pipe is provided with an exhaust valve 112. The control system is respectively connected to the pressure measuring device, the intake valve 111, and the exhaust valve 112, and the control system controls opening and closing of the intake valve 111 or the exhaust valve 112 based on pressure data.

As an embodiment of the present invention, the device further includes a vacuum pump 110, where the vacuum pump 110 is communicated with the microwave reaction chamber 102, and the vacuum pump 110 is configured to vacuumize gas in the microwave reaction chamber 102.

Specifically, an exhaust hole is left at the bottom of the microwave reaction chamber 102, the furnace cover 114 is sealed and is provided with an air inlet hole and a vacuum port, and the air inlet hole is communicated with a gas storage tank 108 through the intake pipe, so that protective gas such as nitrogen and argon enters the microwave reaction chamber 102. The vacuum pump 110 is mainly configured to extract vacuum, to ensure a vacuum environment or to exhaust oxygen, and the microwave reaction chamber 102 has a pressure range of $10^4$-$10^6$ Pa. When the atmospheric pressure in the chamber exceeds $10^6$ Pa, the exhaust valve 112 is automatically switched on.

As an embodiment of the present invention, the device further includes a circulating water cooler 109. The microwave source generator 101 is equipped with an aluminum alloy water cooled jacket, and the circulating water cooler 109 is communicated with the water cooled jacket and is configured to forcibly perform water cooling on the microwave source through a magnetron and ensure continuous operation of the microwave source generator 101.

In this embodiment, the device further includes an alarm device. The device in this embodiment needs to be kept in a closed and circulating water cooling condition during operation. Therefore, under the condition that the circulating water is not connected or the furnace door is not closed, the alarm or power failure protection is activated, the circulating water cooler cannot be started under the condition that the circulating water is not connected, in addition, when the furnace door is open, the microwave source generator is automatically powered off, which is generally controlled by a switching power supply installed in the furnace door.

Preferably, the crucible die 104 is also provided with a plurality of second grooves, where the second grooves are evenly distributed on a second circumference. The first circumference and the second circumference are concentric circles, a plurality of second fixing holes are disposed on a top of the thermal insulation barrel 103, and the second fixing holes are disposed corresponding to the second grooves. A second acquisition hole is disposed on the top of the microwave reaction chamber 102, and the second acquisition hole is located right above the second circumference. When the thermal insulation barrel 103 rotates with the rotary table 105, the temperature acquisition device 107 is configured to acquire temperature of materials in the crucible 106 through the second acquisition hole and the second fixing hole.

Figure 4:
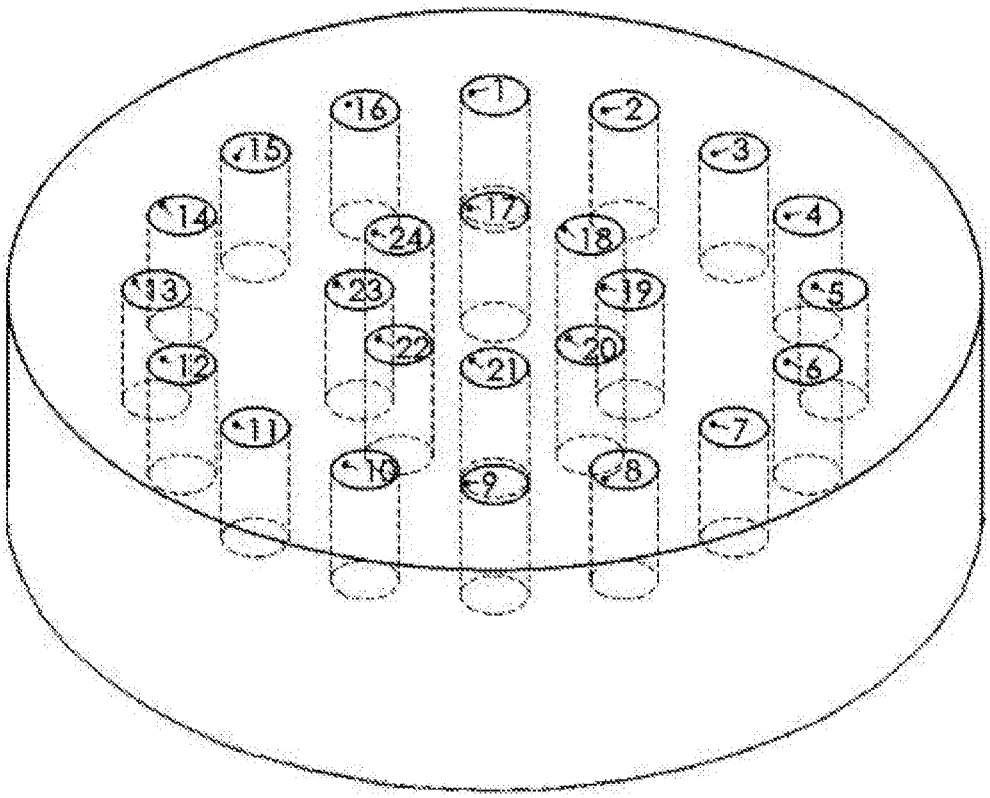
FIG. 4 is a schematic diagram of crucible distribution in a crucible die according to an embodiment of the present invention.
Figure 5:
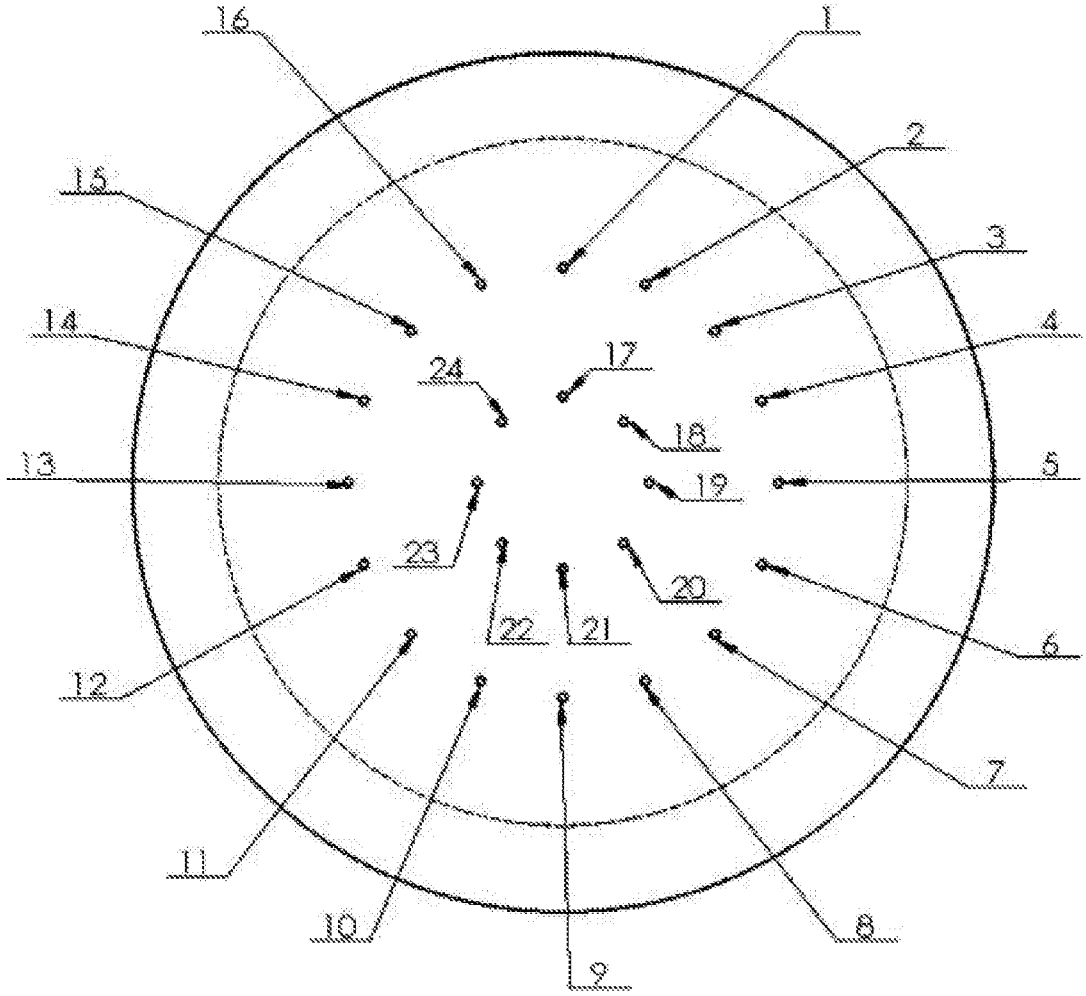
FIG. 5 is a top view of crucible distribution in a crucible die according to an embodiment of the present invention.

FIG. 4 is a schematic diagram of crucible distribution in a crucible die according to an embodiment of the present invention, and FIG. 5 is a top view of crucible distribution in a crucible die according to an embodiment of the present invention. Referring to FIG. 4 and FIG. 5, the crucible die 104 has a cylindrical structure, the first circumference and the second circumference are concentric circles, and the circle center is the center of the bottom of the crucible die 104. The first circumference is evenly distributed with 16 first grooves, the second circumference is evenly distributed with 8 second grooves, and each groove is configured to place the crucible 106. A fixing hole 116 is disposed on the barrel cover of the thermal insulation barrel 103, and distribution of the fixing hole 116 is consistent with that of the grooves. The furnace cover 114 is provided with a first acquisition hole and a second acquisition hole, where the first acquisition hole is located right above the first circumference, and the second acquisition hole is located right above the second circumference. When the rotary table 105 rotates, the crucible 106 and the fixing hole also rotate while the acquisition holes do not rotate, so that the infrared thermometer on the top of the first acquisition hole measures the temperature of the materials of the crucible 106 in each of the first grooves, and the infrared thermometer on the top of the second acquisition hole measures the temperature of the materials of the crucible 106 in each of the second grooves.

Preferably, the crucible 106 is a silicon carbide crucible or a silicon carbide crucible doped with aluminum oxide, silicon oxide, or iron oxide. Specifically, there are a plurality of crucibles 106, and each crucible 106 is correspondingly placed in the groove of the crucible die 104. The crucible 106 has a cylindrical structure, the capacity of the crucible 106 is 0.1-0.5 L/per, and the wall thickness of the crucible 106 is 5-10 mm. The crucible 106 is configured to place materials and perform auxiliary heating, and its composition is silicon carbide, silicon carbide+alumina, silicon carbide+silicon oxide, silicon carbide+iron oxide, but it is not limited to this. Synchronous or asynchronous heating under the same microwave-based heating conditions can be achieved by controlling silicon carbide content in the crucible. Under microwave-based heating conditions, the heating rate can be up to 50° C./min to 70° C./min, and the maximum temperature is 1400±50° C., which significantly improves the heating efficiency and heating rate, shortens the process, and reduces energy consumption, and it is an efficient, clean, energy-saving and convenient multi-functional microwave device. In addition, by controlling the silicon carbide content of the crucible and the rotation speed of the rotary table, single-point accurate temperature measurement of multiple samples is performed, to achieve simultaneous processing of multiple samples at different temperature.

Preferably, the temperature acquisition device 107 is an infrared thermometer, and the infrared thermometer is used for temperature measurement, with a temperature measurement range of 350° C. to 1600° C. When the thermal insulation barrel 103 rotates with the rotary table 105 in the chamber, the temperature in the crucibles 106 that are concentrically distributed is measured by the corresponding infrared thermometer on the top of the furnace cover 114. The temperature measurement interval is controlled by controlling the rotation speed, and data is collected by the control system.

Preferably, the rotary table 105 is made of titanium plates, where the titanium plates are mainly resistant to high temperature, have high strength, and are not easy to generate thermal deformation. In addition, the support plate 115 is disposed on the rotary table 105, and the support plate 115 is made of metal titanium or titanium alloy.

Working Principle:

The process such as microwave material sintering or metal smelting is achieved by microwave-based heating of samples or materials in silicon carbide crucibles. A cylindrical structure and a sintering process are used, which has microwave absorption capability. The crucible containing materials is fed into the crucible die in the microwave reaction chamber, the furnace cover is sealed, the circulating water cooler is opened, the vacuum is extracted to a certain negative pressure, and protective gas such as nitrogen is filled depending on the circumstances, with the pressure less than $10^6$ Pa. A valve is used for protection, then the rotation speed of the rotary table is adjusted through the control system, the corresponding infrared thermometer is turned on, and then the microwave is fed. After the melting or sintering process is completed, the microwave source generator should be turned off before the temperature of the sample has cooled to a safe range before opening the furnace door.

An embodiment of the present invention relates to a microwave-based high-throughput material processing device with a concentric rotary chassis, which relates to technologies such as material sintering, metal and alloy melting, heat treatment, and microwave industrial furnaces. This device uses a microwave-based heating technology to achieve high-throughput processing of metal and alloy melting, material sintering, heat treatment and other processes under same conditions. A combination of single microwave source or multiple microwave sources is used to achieve power amplification, with crucibles made of silicon carbide-based composite materials as material carrying containers and microwave assisted heating elements. The silicon carbide content of the crucible is controlled for temperature rise control, synchronous temperature rise or asynchronous temperature rise is achieved under same conditions. Each crucible is placed in a crucible die on the base of the mullite thermal insulation barrel, each crucible is concentrically distributed, which can be single or multiple layers. When the thermal insulation barrel rotates with the rotary table, the temperature of the materials in each crucible can be measured by the corresponding infrared thermometer on the top. The temperature measurement interval is adjusted by controlling the rotation speed, the data is collected by the control system, and the operation can be operated under the conditions of vacuum or atmosphere protection. The embodiments of the present invention are used for high-throughput preparation processes such as material sintering, metal and alloy smelting, and improve related process processing efficiency. The equipment is simple and efficient in structure, and is easy to operate and maintain. Compared with the traditional electric heating and microwave high temperature processing equipment, the present invention has obvious technical advantages, is suitable for multi-purpose applications such as production and experiment, and has a prospect of promotion.

In this paper, several examples are used for illustration of the principles and embodiments of the present invention. The description of the foregoing embodiments is used to help illustrate the method of the present invention and the core principles thereof. In addition, those skilled in the art can make various modifications in terms of specific embodiments and scope of application in accordance with the teachings of the present invention. In conclusion, the content of the present specification shall not be construed as a limitation to the present invention.

What is claimed is:

1. A microwave-based high-throughput material processing device with a concentric rotary chassis, comprising a microwave source generator (101), a microwave reaction chamber (102), and a temperature acquisition device (107); wherein the microwave source generator (101) is configured to generate a microwave, and transmit the microwave to the microwave reaction chamber (102) through a waveguide tube (113);

the microwave reaction chamber (102) is provided with a rotary table (105), a thermal insulation barrel (103) and a crucible die (104); the rotary table (105) is disposed at a bottom of the microwave reaction chamber (102), the thermal insulation barrel (103) is disposed above the rotary table (105), the crucible die (104) is disposed at a bottom of the thermal insulation barrel (103), and the crucible die (104) is configured to place a crucible 106);

the crucible die (104) is provided with a plurality of first grooves, wherein the first grooves are configured to place the crucible (106), and the first grooves are evenly distributed on a first circumference; a plurality of first fixing holes are disposed on a top of the thermal insulation barrel (103), and the first fixing holes are disposed corresponding to the first grooves; a first acquisition hole is disposed on the top of the microwave reaction chamber (102), and the first acquisition hole is located right above the first circumference; and when the thermal insulation barrel (103) rotates with the rotary table (105), the temperature acquisition device (107) is configured to acquire temperature of materials in the crucible (106) through the first acquisition hole and the first fixing hole.

2. The microwave-based high-throughput material processing device with a concentric rotary chassis according to claim 1, wherein the device further comprises a control system, wherein the control system is respectively connected to the temperature acquisition device (107) and the microwave source generator (101), and the control system adjusts power of the microwave source generator (101) based on temperature data acquired by the temperature acquisition device (107).

3. The microwave-based high-throughput material processing device with a concentric rotary chassis according to claim 2, wherein the device further comprises a pressure measuring device, configured to measure a pressure in the microwave reaction chamber (102); the microwave reaction chamber (102) is provided with an intake pipe and an exhaust pipe, wherein the intake pipe is provided with an intake valve (111), and the exhaust pipe is provided with an exhaust valve (112); and the control system is respectively connected to the pressure measuring device, the intake valve (111), and the exhaust valve (112), and the control system controls opening and closing of the intake valve (111) or the exhaust valve (112) based on pressure data.

4. The microwave-based high-throughput material processing device with a concentric rotary chassis according to claim 1, wherein the device further comprises a vacuum pump (110), the vacuum pump (110) is communicated with the microwave reaction chamber (102), and the vacuum pump (110) is configured to vacuumize gas in the microwave reaction chamber (102).

5. The microwave-based high-throughput material processing device with a concentric rotary chassis according to claim 1, wherein the device further comprises a circulating water cooler (109), and the circulating water cooler (109) is communicated with a water cooled jacket on the microwave source generator (101) and is configured to cool the microwave source generator (101).

6. The microwave-based high-throughput material processing device with a concentric rotary chassis according to claim 1, wherein the crucible die (104) is also provided with a plurality of second grooves, wherein the second grooves are configured to place the crucible (106), and the second grooves are evenly distributed on a second circumference; the first circumference and the second circumference are concentric circles, a plurality of second fixing holes are disposed on a top of the thermal insulation barrel (103), and the second fixing holes are disposed corresponding to the second grooves; a second acquisition hole is disposed on the top of the microwave reaction chamber (102), and the second acquisition hole is located right above the second circumference; and when the thermal insulation barrel (103) rotates with the rotary table (105), the temperature acquisition device (107) is configured to acquire temperature of materials in the crucible (106) through the second acquisition hole and the second fixing hole.

7. The microwave-based high-throughput material processing device with a concentric rotary chassis according to claim 1, wherein the crucible (106) is a silicon carbide crucible or a silicon carbide crucible doped with aluminum oxide, silicon oxide, or iron oxide.

8. The microwave-based high-throughput material processing device with a concentric rotary chassis according to claim 1, wherein the temperature acquisition device (107) is an infrared thermometer.

9. The microwave-based high-throughput material processing device with a concentric rotary chassis according to claim 1, wherein the thermal insulation barrel (103) is made of mullite materials.

10. The microwave-based high-throughput material processing device with a concentric rotary chassis according to claim 1, wherein the rotary table (105) is made of titanium plates.

* * * * *